US009088100B2

(12) United States Patent
Volantin

(10) Patent No.: US 9,088,100 B2
(45) Date of Patent: Jul. 21, 2015

(54) CONNECTOR WITH SECURE ENGAGEMENT

(75) Inventor: Christian Volantin, Conflans-Sainte-Honorine (FR)

(73) Assignee: Tyco Electronics France SAS, Pontoise (FR)

( * ) Notice: Subject to any disclaimer, the term of this patent is extended or adjusted under 35 U.S.C. 154(b) by 89 days.

(21) Appl. No.: 13/881,690

(22) PCT Filed: Oct. 18, 2011

(86) PCT No.: PCT/EP2011/068151
§ 371 (c)(1),
(2), (4) Date: Apr. 25, 2013

(87) PCT Pub. No.: WO2012/055723
PCT Pub. Date: May 3, 2012

(65) Prior Publication Data

US 2013/0237087 A1 Sep. 12, 2013

(30) Foreign Application Priority Data

Oct. 26, 2010 (FR) ..... 10 58811

(51) Int. Cl.
*H01R 13/62* (2006.01)
*H01R 13/629* (2006.01)
(Continued)

(52) U.S. Cl.
CPC .... *H01R 13/62927* (2013.01); *H01R 13/62938* (2013.01); *H01R 13/62944* (2013.01); *H01R 13/62955* (2013.01); *H01R 13/639* (2013.01); *H01R 13/641* (2013.01)

(58) Field of Classification Search
CPC ..... H01R 13/62938; H01R 13/641
USPC ..... 439/483, 157
See application file for complete search history.

(56) References Cited

U.S. PATENT DOCUMENTS 5,637,003 A 6/1997 Takahashi
5,873,745 A * 2/1999 Duclos et al. ..... 439/157
(Continued)

FOREIGN PATENT DOCUMENTS

EP 1069653 A1 1/2001
EP 2110895 A1 10/2009
WO WO 2009137615 A1 * 11/2009

OTHER PUBLICATIONS

International Search Report and Written Opinion issued by the European Patent Office, dated Jan. 10, 2012, for related International Application No. PCT/EP2011/068151; 14 pages.
(Continued)

*Primary Examiner* — Neil Abrams
*Assistant Examiner* — Travis Chambers
(74) *Attorney, Agent, or Firm* — Faegre Baker Daniels LLP

(57) ABSTRACT

A connector comprising a first module (1) on which a lever (6) is mounted so as to be able to rotate, and a second module (2), the first and second modules having complementary engagement profiles and receiving complementary contact elements, the lever (6) and the second module (2) comprising complementary means (8, 9) for driving the second module (2) in translation in a coupling direction of the first and second modules (1, 2), under the action of the rotation of the lever (6), the driving means (8, 9) being suitable for abutting to block the coupling before the contact between the complementary contact elements is established upon the introduction of the second module (2) into the first module (1) as long as the lever (6) does not occupy a rotation-stroke starting position for the purpose of the driving in translation.

23 Claims, 8 Drawing Sheets

(51) Int. Cl.
*H01R 13/641* (2006.01)
*H01R 13/639* (2006.01)

(56) References Cited

U.S. PATENT DOCUMENTS

| | | | | |
|---|---|---|---|---|
| 2002/0177338 | A1 | 11/2002 | Nishide et al. | |
| 2002/0182491 | A1 | 12/2002 | Maegawa | |
| 2007/0287310 | A1 | 12/2007 | Dekoski et al. | |
| 2008/0076283 | A1* | 3/2008 | Bouchan et al. | 439/157 |
| 2009/0246992 | A1* | 10/2009 | Martin | 439/157 |

OTHER PUBLICATIONS

Preliminary Search Report and Written Opinion (in French language) issued by the French National Institute of Industrial Property, dated May 16, 2011, for related Application No. FR 1058811; 9 pages.

International Preliminary Report on Patentability issued by the International Bureau of WIPO, Geneva, Switzerland, dated Apr. 30, 2013, for related International Application No. PCT/EP2011/068151; 9 pages.

* cited by examiner

CONNECTOR WITH SECURE ENGAGEMENT

The present invention relates to a connector provided with a coupling aid lever.

It relates more particularly to a connector comprising a female casing module or element, in the bottom of which there is a series of male electrical contact pins, and a male casing module or element having a complementary engagement profile in the female module and comprising a series of female electrical contact members which are intended to cooperate with the male contacts, or vice versa.

Owing to the large number of paths to be connected, a large force generally has to be exerted in order to effect the coupling. Because of this, these connectors also comprise a coupling aid lever.

In practice, this lever is toothed to mesh with complementary teeth provided on the module which is intended to be connected to the module bearing this lever, in order to drive the second module in the coupling direction of the first and second modules by maneuvering this lever. It may be noted in particular, with regard to this type of connector, that engagement of the two modules is possible whatever the position of the lever, with the result that the electrical contact between male and female contact was incorrectly, or even not at all, established once the lever had arrived at the end of its stroke. Furthermore, breakages of teeth on the lever or second module have also been noted.

The subject of the present invention, generally, is an arrangement which makes it possible to overcome these drawbacks, and furthermore results in other advantages.

More precisely, its subject is a connector comprising a first module on which a lever is mounted so as to be able to rotate, and a second module, the first and second modules having complementary engagement profiles and receiving complementary contact elements, the lever and the second module comprising complementary means for driving the second module in translation in a coupling direction of the first and second modules, under the action of the rotation of the lever, the driving means being suitable for abutting to block the coupling before the contact between the complementary contact elements is established, upon the introduction of the second module into the first module as long as the lever does not occupy a rotation-stroke starting position for the purpose of the driving in translation.

In other words, according to the invention, the presence of the driving means is turned to good account to block therewith the coupling of the two modules before the electrical contact is established between the complementary contact elements as long as the lever does not occupy a rotation-stroke starting position upon the introduction of the second module into the first module.

The result is driving of the second module as far as the coupling end position in an absolutely secure manner, without the risk of damaging the corresponding driving means.

Furthermore, an electrical contact between the complementary contact elements is only possible, due to the present invention, if the coupling end position can be reached, thus guaranteeing secure, unfailing electrical contact, without ever giving the illusion of correct coupling which might, for example, result from friction or sticking between elements.

The arrangement according to the invention advantageously lends itself to a development according to which the lever and the second module comprise complementary means for reciprocal locking of the first and second modules in a coupling end position, preventing any risk of uncoupling, for example under the effect of vibrations.

According to other arrangements, possibly taken in combination, and selected in particular for reasons of convenience of manufacture:

- the lever comprises, for the driving in translation of the second module, at least one structure forming a cam track suitable, upon the maneuvering of the lever, for acting on a cam-follower member protruding from the second module;
- the lever comprises at least one arched prominence, which is fixed with respect to rotation on the lever and forms internally a cam track for the respective cam-follower member and externally an abutment surface for this same cam-follower member upon the introduction of the second module into the first module as long as the lever does not occupy a rotation-stroke starting position;
- the cam-follower member is a peg;
- the lever comprises, on an inner face of a maneuvering arm turned towards the first module, a mounting protuberance engaged to rotate in an orifice of a lateral wall of the first module;
- the arched prominence protrudes from a protrusion which is overall in the shape of a disc which is coaxial to the axis of rotation of the lever, which disc itself protrudes from the mounting protuberance;
- the lever and the second module comprise complementary means for reciprocal locking in a coupling end position;
- the means for locking in a coupling end position comprise a tooth on the second module and at least one hump which is fixed with respect to rotation on the lever, and is suitable for engaging with a sidewall of such a tooth;
- said at least one arched prominence tapers towards one of its free ends, by means of which it is capable of engaging with a respective flank of a tooth of the second module in order to participate in the reciprocal locking of the first and second modules in the coupling end position;
- said at least one locking hump has, on one hand, a central part which is semicircular overall, the curved surface of which is turned towards the cam track, in order to form therewith a receiving channel for the respective cam-follower member, and, on the other hand, a nose and a locking head which is suitable for engaging with the flank of the complementary respective tooth provided on the second module, the nose and the head extending the central part so as to form between them an indentation capable of straddling this tooth upon the maneuvering of the lever;
- the head of the hump is suitable for participating in the driving in translation of the second module upon the maneuvering of the lever;
- the locking hump protrudes from the protrusion which is overall in the shape of a disc;
- one of the first and second modules comprises at least one rail for guiding in translation in the coupling direction, and the other comprises at least one groove in which a guide rail is intended to slide;
- the connector comprises means for locking the lever with respect to rotation in its rotation-stroke starting position, which are suitable for being disengaged under the action of the introduction of the second module into the first module.

According to another aspect, a connector is provided comprising a first module on which a lever is mounted so as to be able to rotate, and a second module, the first and second modules having complementary engagement profiles and receiving complementary contact elements, the lever and the second module comprising complementary means for driving the second module in translation in a coupling direction of the first and second modules, under the action of the rotation of the lever, the connector comprising means for locking the lever with respect to rotation in its rotation-stroke starting position, which means are suitable for being disengaged under the action of the introduction of the second module into the first module.

Thus, any risk of driving taking place when the lever has not been positioned beforehand in its rotation-stroke starting position is also eliminated by using such a connector.

As will be seen in greater detail hereafter, this aspect may be combined with the previous one.

According to particular arrangements relative to this aspect, possibly taken in combination and selected in particular for reasons of convenience of manufacture:

- the first module comprises, for the locking of the lever with respect to rotation, at least one elastically deformable arm having, on one hand, a protrusion via which it is suitable for engaging with a complementary protrusion of the lever for blocking the latter with respect to rotation and, on the other hand, a ramp by which, for the deflection thereof and thus the releasing of the lever, it interferes with the path of an appendage which is integral with the second module.
- said at least one elastically deformable arm extends parallel to the coupling direction of the first and second modules and is connected by a transverse tab to a wall of the first module.
- the elastically deformable arm bears the protrusion and the ramp at the free end which is at the opposite end from the one by which it is connected to the wall of the module.
- the protrusion and the ramp are arranged side by side.
- the protrusion and the ramp extend in the vicinity of the end of the first module which is at the opposite end from the one by which the second module is engaged in the first module.
- the lever comprises two lateral branches connected by a central branch, so as to form a double lever, arranged straddling the first module.
- the first module comprises an interfacial seal.
- the complementary contact elements are in the form of pins and female electrical contact members which are suitable for receiving these pins.
- the lever and each module are moulded from plastics material.

Other characteristics and advantages of the invention will furthermore become apparent from the following description, by way of illustrative, non-limitative example, with reference to the appended diagrammatic drawings in which identical, similar or equivalent parts are marked with the same numerical references. Furthermore, for reasons of clarity of the figures, the different elements are not shown on the same scale.

As can be seen in FIGS. 1 to 3 and 4A to 4E, a connector in accordance with a first embodiment of the present invention comprises a first module 1 and a second module 2 which have complementary engagement profiles and receive complementary contact elements.

Figure 1:
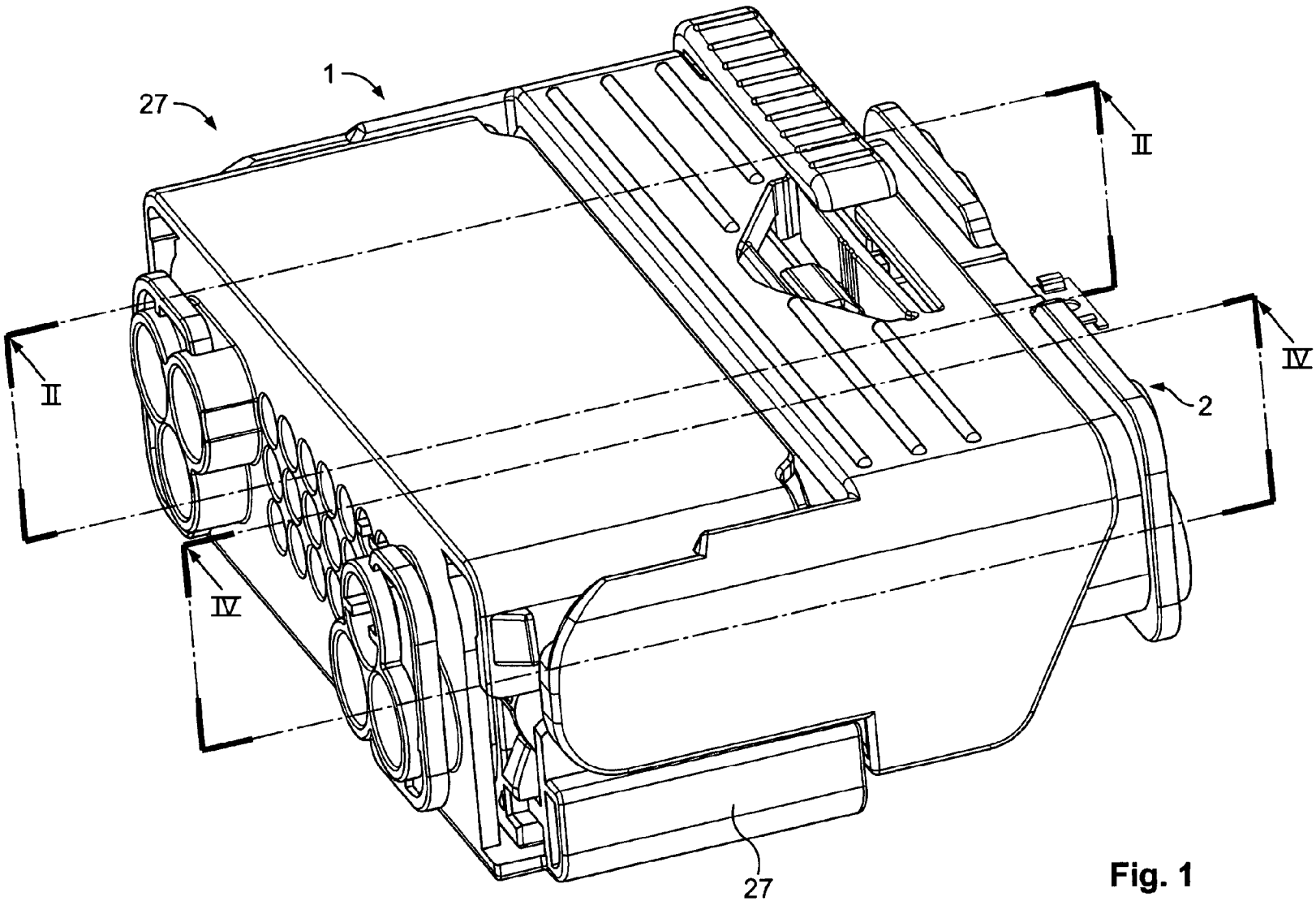
FIG. 1 is a perspective view of a connector according to a first embodiment of the invention.
Figure 2:
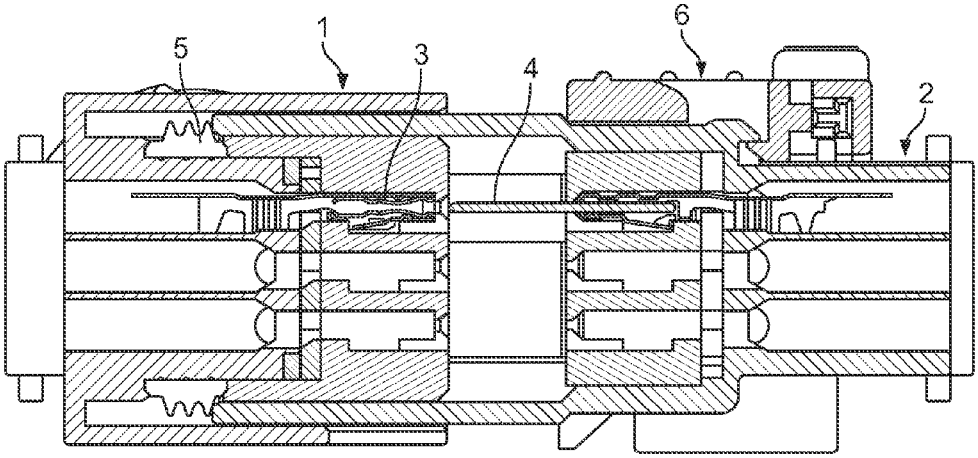
FIG. 2 is a view in cross-section of this connector, along the plane II-II of FIG. 1.
Figure 3:
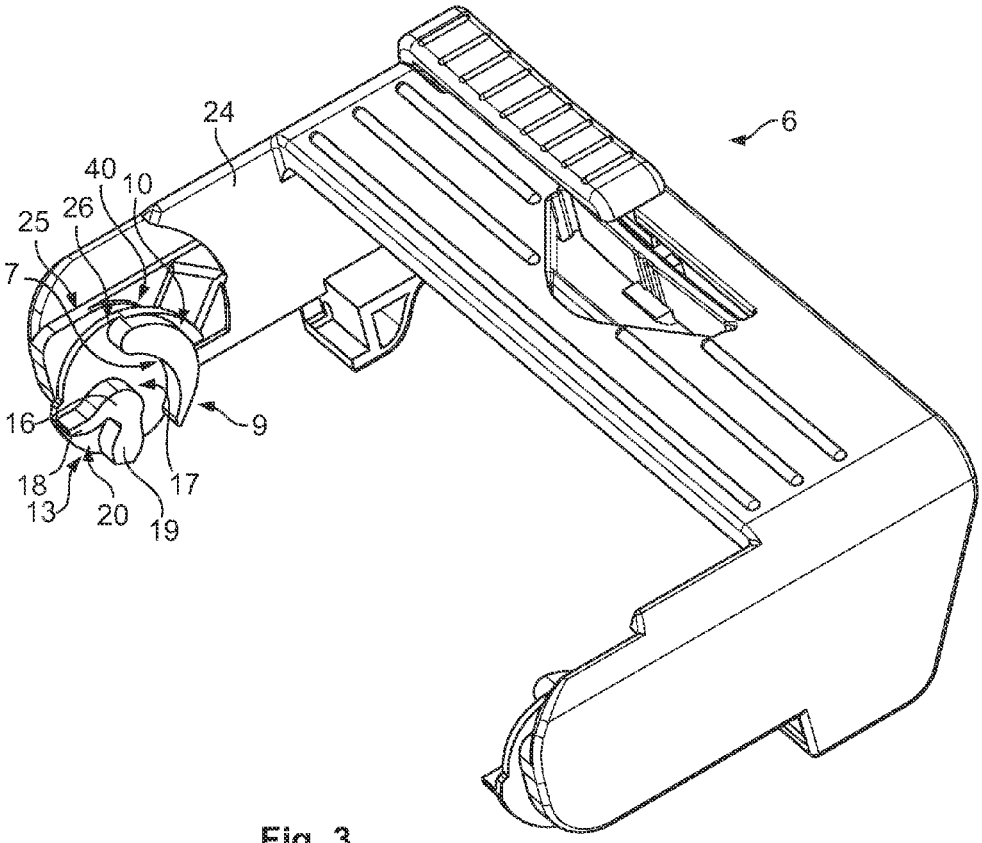
FIG. 3 is a perspective view of the lever of the connector of FIG. 1.

More precisely, the first module 1 is a female element comprising female electrical contact members which are housed in a casing, only one of these members, marked 3, having been shown in FIG. 2 for reasons of clarity.

The second module 2 is a male element also comprising a casing, one end of which is intended to be inserted in the casing of the female element, and for which purpose pins are housed which are intended to cooperate with the female electrical contact members, only one thereof, marked 4, being shown in FIG. 2 for reasons of clarity.

In practice, this is a hybrid connector, that is to say one which receives pins having different diameters. In the case of the present embodiment, 19 1.2 mm contacts and 6 2.8 mm contacts are provided.

These complementary contact elements are, for example, connected to cables which emerge from ducts formed in the first and second modules which receive the pins and female contact members.

An interfacial seal 5 is furthermore housed in the bottom of the casing of the female element.

The arrangements which have just been described are well-known per se and will therefore not be described in detail here. It will however be noted that a converse arrangement may be provided, namely pins in the female element and female contact members in the male element, and that the pins may, for example, be replaced by tongues.

A lever 6 is mounted so as to be able to rotate on this first module 1, and comprises, with the second module 2, complementary means for driving the second module in translation in a coupling direction of the first and second modules, under the action of the rotation of this lever 6.

The lever 6 and the second module 2 here furthermore comprise complementary means for reciprocal locking in a coupling end position.

In practice, the lever 6 comprises, for the driving in translation of the second module 2, a structure forming a cam track 7 which is suitable, upon the maneuvering of the lever 6, for acting on a cam-follower member 8 protruding from the second module 2. The cam-follower member 8 is here a peg, whereas the lever 6 comprises, in order to cooperate with this peg, an arched prominence 9, which is fixed with respect to rotation on the lever 6 and forms internally, on the side of its concavity, said cam track 7. On the opposite side (convexity), this prominence 9 forms an abutment surface 10 for the cam-follower member 8, upon the introduction of the second module 2 into the first module 1 as long as the lever 6 does not occupy a rotation-stroke starting position.

Figure 4A:
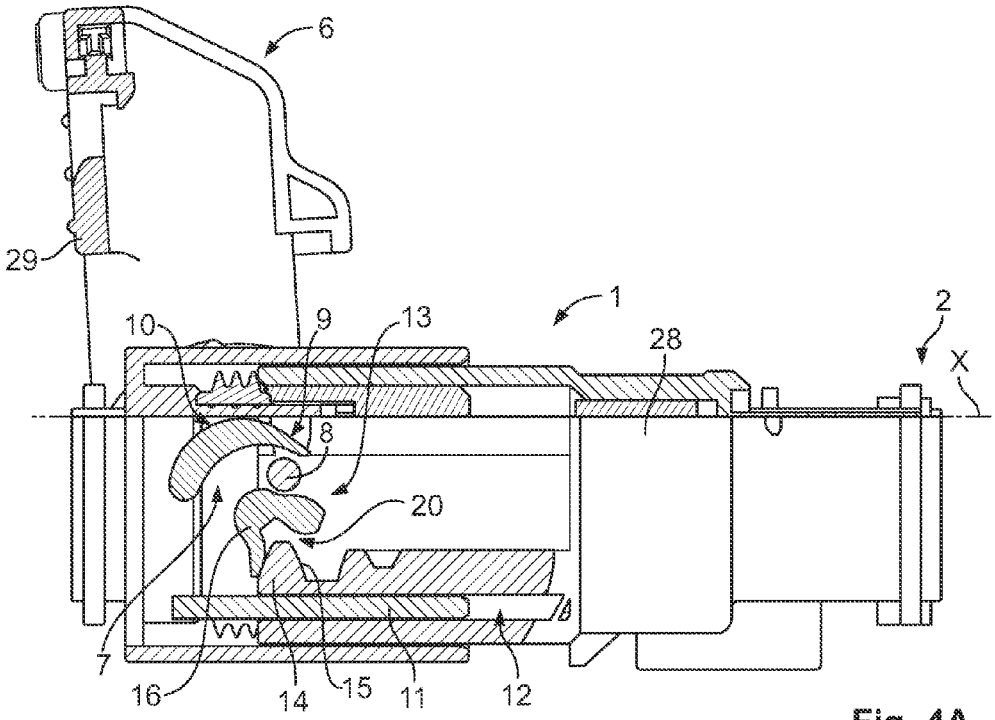
FIGS. 4A to 4E depict a coupling sequence for the first and second modules of the connector of FIG. 1, which are represented by a split section, which for the part above the line X of FIG. 4A follows the section plane II-II and for the part below this line X follows the section plane IV-IV of FIG. 1.
Figure 4B:
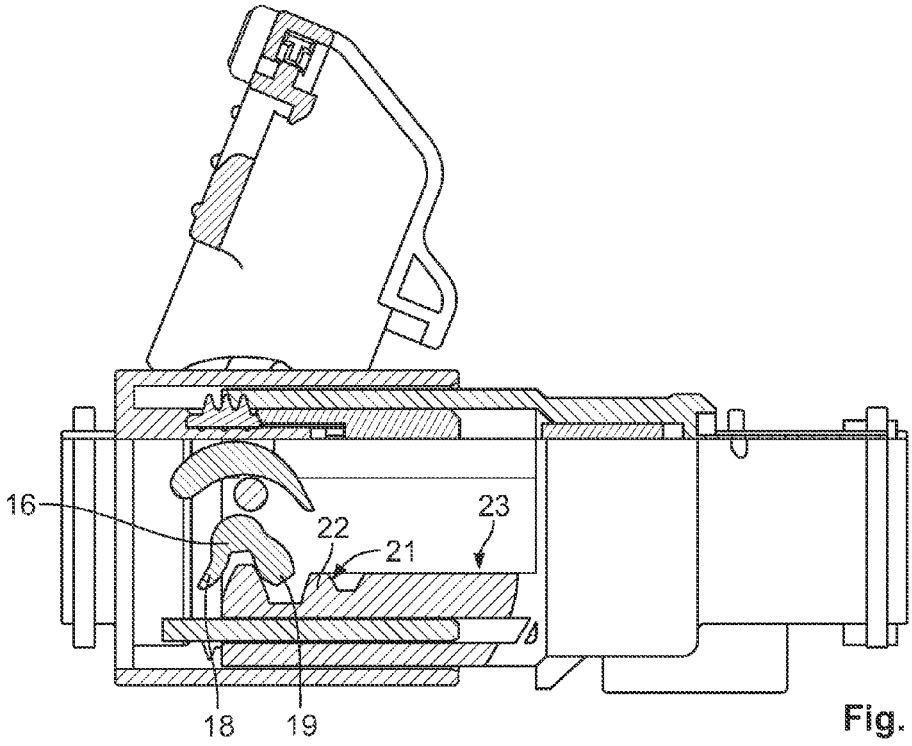
Figure 4C:
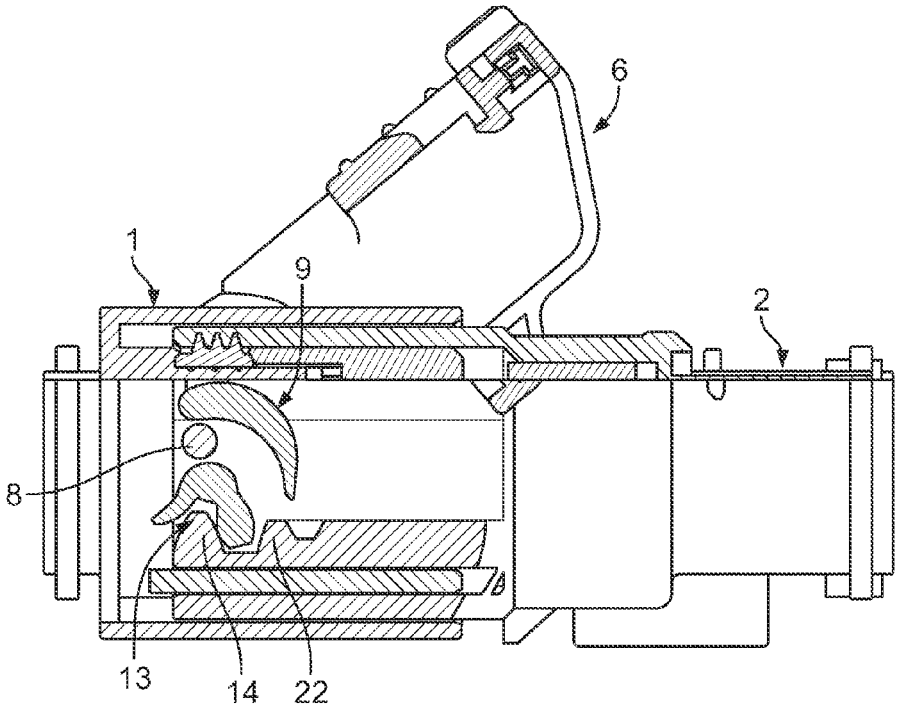
Figure 4D:
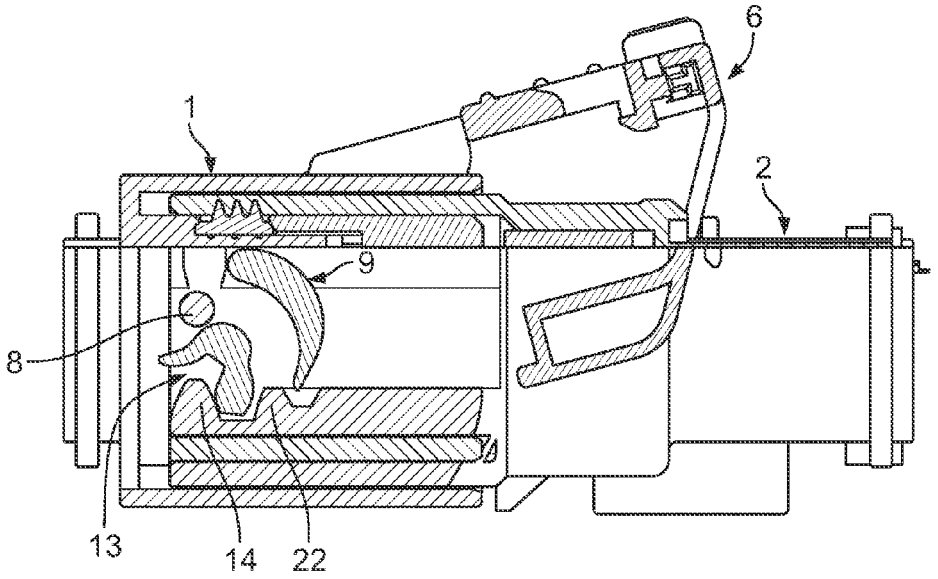
Figure 4E:
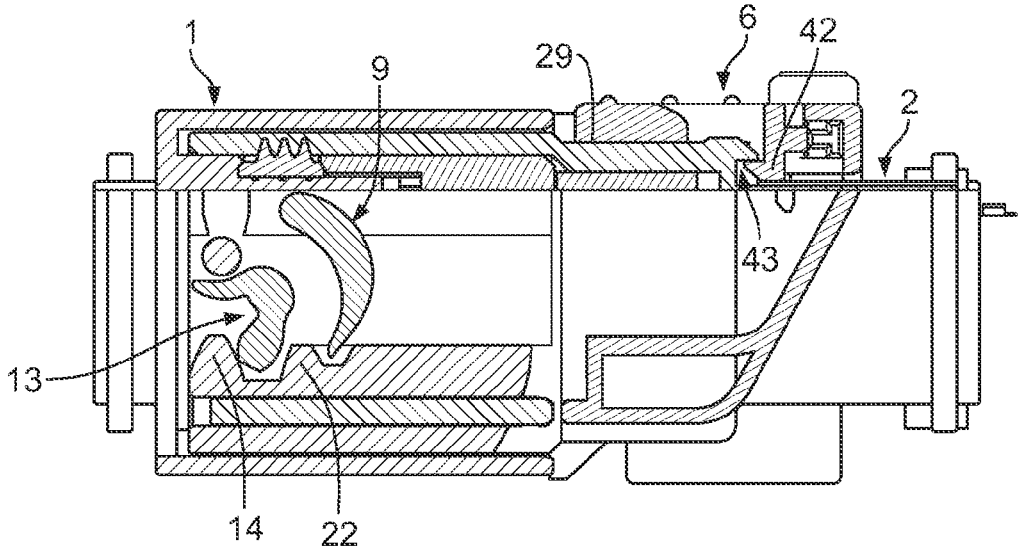

Thus, as will be seen in greater detail hereafter, the coupling of the first and second modules 1, 2 is blocked before the electrical contact is established between the complementary contact elements 3, 4, upon the introduction of the second module 2 into the first module 1 as long as the lever 6 does not occupy its rotation-stroke starting position, that is to say here a position in which it extends overall transversely to the coupling direction (line X; FIG. 4A).

In order to limit the movement of the modules 1, 2 to translation upon this coupling, the first module 1, in the context of the present embodiment, is furthermore provided with a rail 11 for guiding in translation in this coupling direction, and the second module 2 comprises a complementary groove 12 in which this guide rail 11 is intended to slide.

For the reciprocal locking of the first and second modules 1, 2 in the coupling end position, the locking means comprise a locking hump 13, which is fixed with respect to rotation on the lever 6, and a complementary locking tooth 14 which is provided on the second module 2 with a flank 15 with which the locking hump 13 is suitable for engaging.

In the case of the present embodiment, the locking hump 13 has, on one hand, a central part 16 which is semicircular overall, the curved surface 17 of which is turned towards the cam track 7, in order to form therewith a receiving channel for the peg forming the cam-follower member 8 and, on the other hand, a nose 18 and a locking head 19 which is suitable for engaging with the flank 15 of the associated locking tooth 14, provided on the second module 2. This nose 18 and this head 19 extend the central part 16 so as to form between them an indentation 20 capable of straddling the locking tooth 14 upon the maneuvering of the lever 6. As will be seen in greater detail hereafter, the head 19 of the hump is here suitable for participating in the driving in translation of the second module 2 upon the maneuvering of the lever 6.

Similarly, the arched prominence 9 here tapers towards one of its free ends, by which it is capable of engaging with a flank 21 of an additional tooth 22 of the second module 2, in order to participate in the reciprocal locking of the first and second modules, in the coupling end position.

In practice, as can be seen in FIGS. 4A-4E, the two teeth 14 and 22 of the second module 2, which are intended to cooperate with the hump 13 and the arched prominence 9, are formed one behind the other in a rib 23 which runs along a lateral wall 28 of the second module 2 and in which, furthermore, is formed the guide groove 12.

In other words, the rib 23 is notched in order to cooperate in locking with the lever 6.

The lever 6 comprises here, in one piece, on an inner face of a maneuvering arm 24, a mounting protuberance 25, while the arched prominence 9 and the locking hump 13 protrude from a protrusion which is overall in the shape of a disc 26, which itself protrudes from the mounting protuberance 25 and defines, with the lever arm 24 from which this mounting protuberance 25 protrudes, a groove 40 on the periphery of the latter.

The mounting protuberance 25 can thus be engaged to rotate in an orifice of a lateral wall 27 of the first module 1. This orifice opens out on to the outside of the first module via a section of the corresponding lateral wall in order to form an introduction segment for the protuberance 25 (of second embodiment, FIG. 6).

The arched prominence 9 and the locking hump 13 form one and the same piece with the mounting protuberance 25, being moulded from plastics material therewith.

Furthermore, the arched prominence 9 and the locking hump 13 are housed in a lateral space between an outer lateral wall 27 of the first module 1 and an inner lateral wall 41 defining the receiving housing for the female members 3.

As will be seen better in the light of the description of FIGS. 4A to 4E below, this space, upon the coupling, receives a lateral wall 28 of the second module 2 which is provided with the peg forming the cam-follower member 8 and with the notched and grooved rib 23.

The lever 6 here is in fact a double lever, arranged straddling the first module, and comprises two mounting protuberances 25 arranged in opposition on its axis of rotation which are engaged to rotate in two facing orifices, formed in two parallel outer lateral walls 27 of the first module 1.

The same therefore applies to the complementary means for driving the second module 2 in translation, the complementary means for reciprocal locking in the coupling end position and the elements for guiding in translation, which are all present in duplicate on either side of the first and second modules 1, 2.

FIGS. 4A-4E depict the process of coupling a connector in accordance with the present invention.

In FIG. 4A, the second module 2 is introduced into the first module 1, with the lever 6 arranged in the stroke starting position, that is to say oriented transversely to the coupling direction.

The guide rails 11 are engaged to slide in the respective grooves 12.

When the lever 6 is thus arranged, once the second module 2 is sufficiently engaged in the first module 1, the arched prominence 9 will be able to cooperate, by means of its cam track 7, with the peg forming the cam-follower member 8 which is engaged in the channel formed between this arched prominence 9 and the locking hump 13.

The rotation of the lever 6 brings about the rotation of the arched prominence 9, and consequently the driving in translation of the second module 2 in the direction of the coupling end position.

At the start of the process (FIG. 4B), the locking hump 13 participates in this driving in translation, straddling the tooth 14 with which it will subsequently engage for reciprocal locking of the two modules (1, 2).

Once the coupling end position is reached (FIGS. 4C to 4E), due to the cam effect produced by the arched prominence 9, helped here in this by the locking hump 13, the continuation of the rotation of the maneuvering lever 6 causes this locking hump 13, but here too the arched prominence 9, to become engaged in the notched rib 23, each engaging with the flank of a tooth, and consequently bringing about reciprocal locking of the first and second modules (1, 2).

It will also be observed that in this coupling end position, the interfacial seal 5 is compressed between the first and the second module (1, 2), preventing any penetration of humidity or foreign objects into the connector. Furthermore, the central branch 29 connecting the two maneuvering arms 24 of the double lever then rests on the second module 2.

In this same coupling end position, locking is effected here as well by a latching element 42, located on the lever 6, which, in order to cooperate in latching, moves back into a window 43 in the second module 2.

Thus accidental raising of the lever 6 towards its rotation-stroke starting position is prevented.

There results from the preceding arrangements a driving of the second module as far as the coupling end position in an absolutely secure manner, without the risk of damaging the corresponding driving means.

Figure 5:
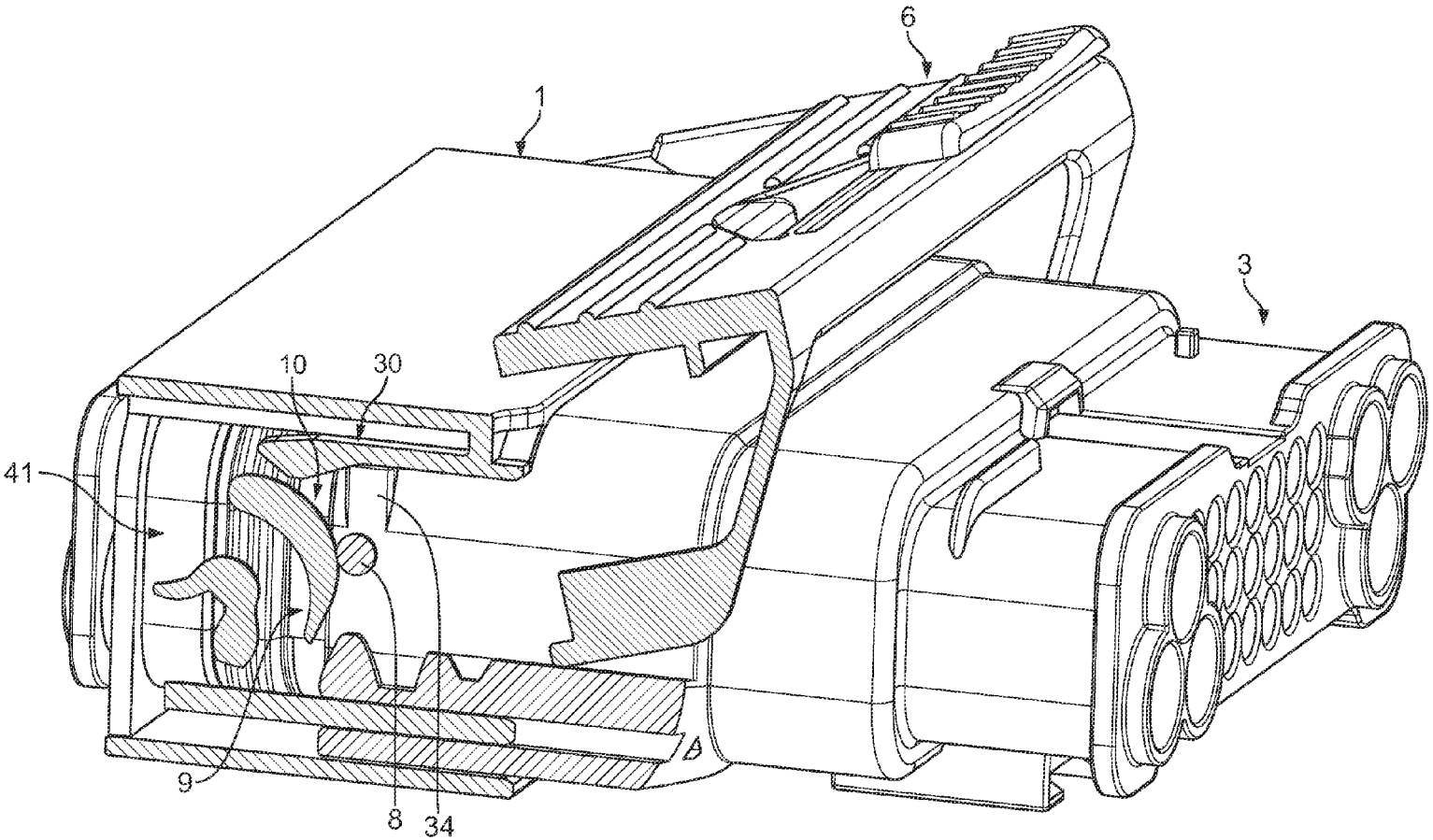
FIG. 5 is a perspective view of a connector, showing an abutment situation for the driving means in the case of a connector in accordance with a second embodiment of the invention and a section similar to that of the plane IV-IV of FIG. 1.

In fact, as long as the lever 6 does not occupy a rotation-stroke starting position upon the introduction of the second module 2 into the first module 1, the peg forming the cam-follower member 8 abuts against the convex surface 10 of the arched prominence 9, blocking the coupling of the two modules 1, 2 before the electrical contact is established between the complementary contact elements. Quite on the contrary, the lever 6 will push the second module 2 backwards to oppose its coupling by sliding on the peg 8 (see FIG. 5).

Consequently, an electrical contact between the complementary contact elements 3 and 4 is only possible, thanks to the present invention, if the coupling end position can be attained, thus guaranteeing secure, unfailing electrical contact, without ever giving the illusion of correct coupling which might, for example, result from friction or sticking between elements.

These driving means furthermore guarantee reciprocal locking of the first and second modules 1, 2 which is effective in the coupling end position, making the connector of the present invention particularly appropriate for use in environments which may be subject to significant vibrations.

Furthermore, upon the coupling, no friction point is encountered by the second module 2.

According to another embodiment, shown in FIGS. 6 and 7A-7C, the guarantee of complete driving by a maneuvering lever until the coupling end position is reached is obtained by the use of means for locking the lever with respect to rotation in its stroke starting position which are suitable for being disengaged under the action of the introduction of the second module into the first module.

More precisely, the first module 1 comprises, for each maneuvering arm 24 of the lever 6, an elastically deformable arm 30 having, on one hand, a protrusion 31 by means of which it is suitable for engaging with a complementary protrusion 32 of the lever 6 for blocking the latter with respect to rotation and, on the other hand, a ramp 33 via which, for its deflection and thus the releasing of the lever, it interferes with the path of an appendage 34 integral with the second module 2.

In practice, this elastically deformable arm 30 extends parallel to the coupling direction, in the space provided between the external lateral wall 27 of the module on which the lever is mounted so as to be able to turn, and the lateral wall parallel to the housing receiving the female contact members, that is to say the space also receiving the means for driving in translation and those for reciprocal locking of the two modules.

Figure 7A:
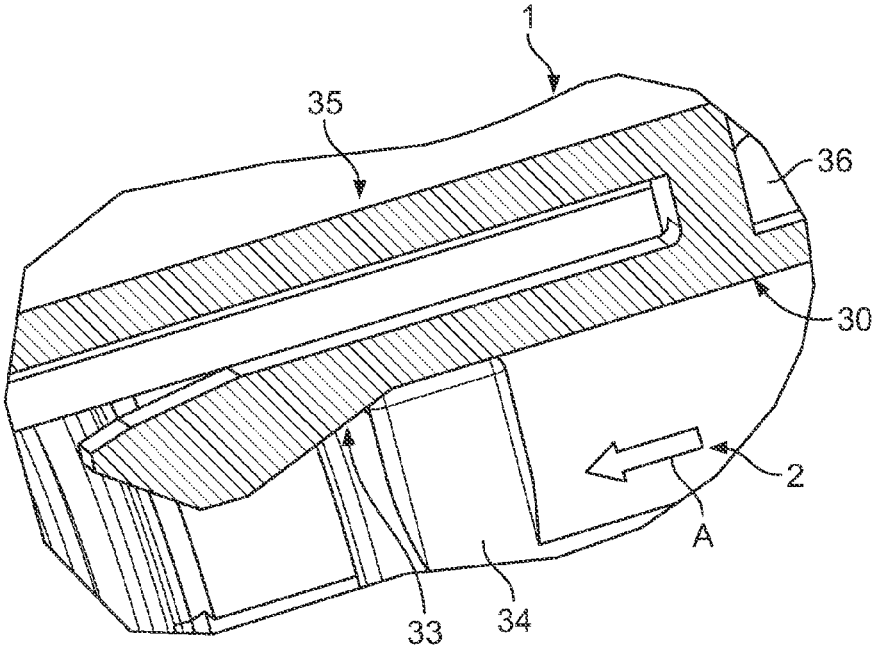
FIGS. 7A and 7B are partial views of this same connector, showing a coupling sequence of the first and second modules.

As can be seen more clearly in FIG. 7A, this elastically deformable arm 30 is here connected to an upper wall 35 of the module, extending transversely to the outer lateral wall 27 of this same module, owing to a transverse tab 36.

This protrusion 31 and ramp 33 are here arranged side by side, the ramp 33 being in the distal position relative to the outer lateral wall 27 of the first module 1, whereas the protrusion 31 is located in the proximal position relative to this same wall. They both protrude beneath the elastically deformable arm, in the direction of the lower transverse wall of this first module, at the free end of the arm which is at the opposite end from the one by which it is connected to the upper transverse wall 35. They are thus situated, in the case of the present embodiment, close to the end of the first module 1 through which the cables emerge, that is to say the one at the opposite end from the end for engagement of the second module 2 in the first module 1.

In order to make this elastically deformable arm deflect, there is provided on the second module 2, as indicated above, an appendage 34 having here overall the shape of a straight prism, the base of which is a right-angled triangle and the right-angle of which projects from the module. This appendage 34 is formed in one piece with the second module 2 and extends above the peg forming the cam-follower member 8.

As the lever here is also a double lever, two similar elastically deformable arms are preferably provided on the sides of the first module in order to cooperate with a corresponding maneuvering arm of the lever.

As for the rest, the connector is similar to that of the first embodiment. It will however be observed that the first module 1, in the case of this second embodiment, is provided with a stop face 37, preventing the lever 6 from turning in a direction opposite to the one for controlling the driving means, beyond its rotation-stroke starting position, in which it extends transversely to the coupling direction.

Figure 6:
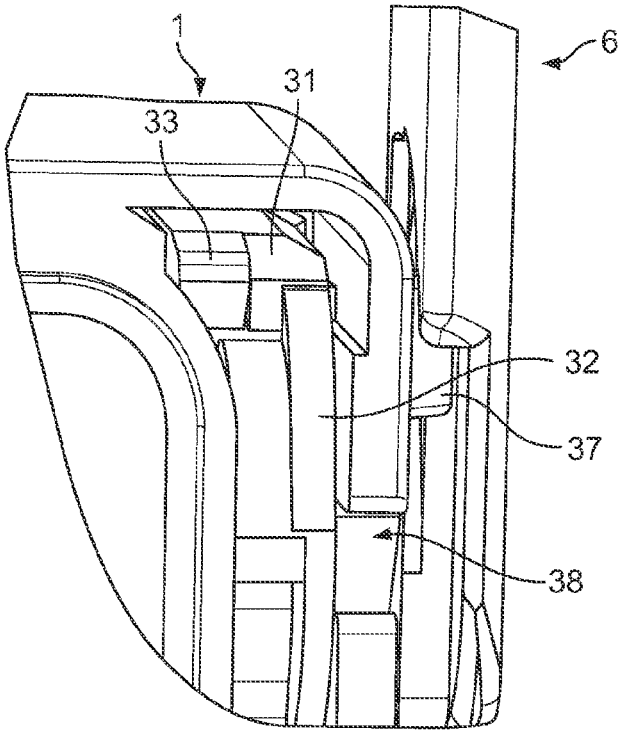
FIG. 6 is a partial view of the connector according to the second embodiment of the invention.

It will also be observed that the orifice 38 in which the lever 6 is engaged to rotate and which opens on to the outside of the first module is visible in FIG. 6.

The lever 6 is thus pre-locked in the rotation-stroke starting position and cannot commence its rotation stroke for controlling the driving means until the second module 2 is engaged in the first module 1 over a sufficient distance to enable the lever 6 to bring the second module 2 into its coupling end position.

Figure 7B:
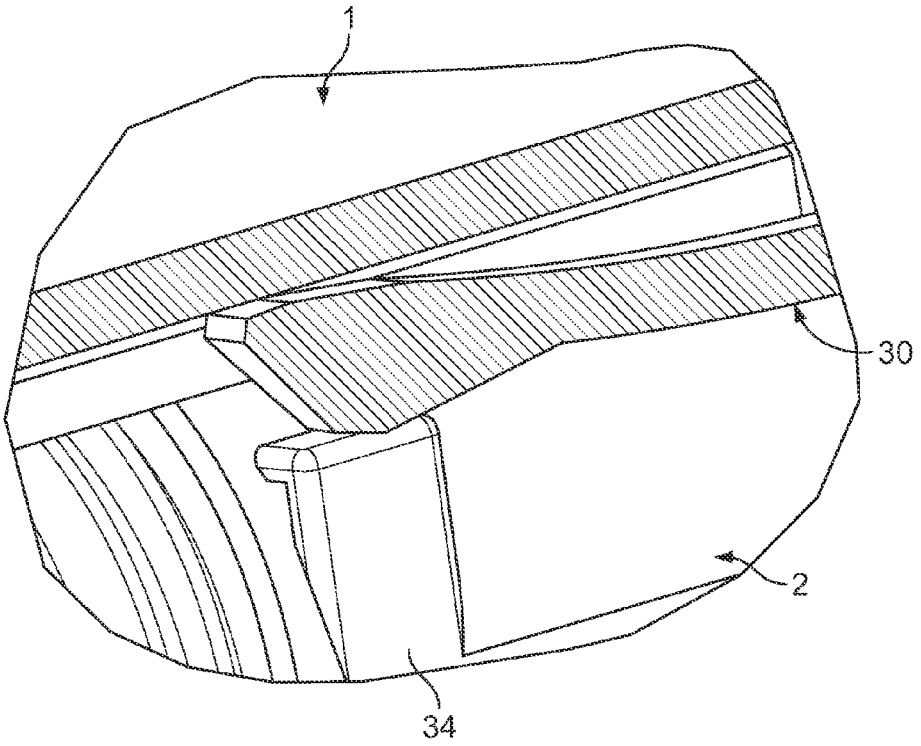
Figure 7C:
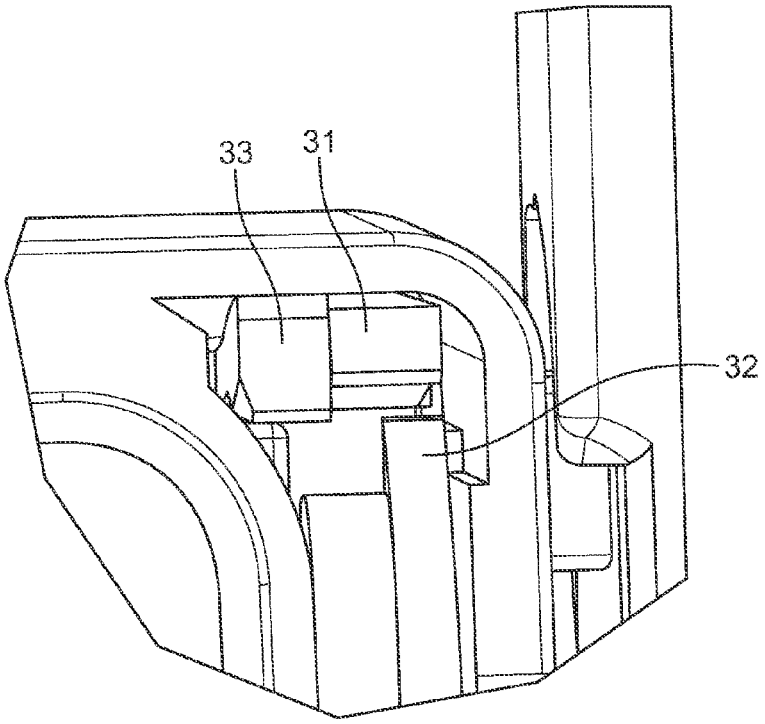
FIG. 7C is a partial view similar to FIG. 6, when the first and second modules are in a coupling position corresponding to that of FIG. 7B.

In practice, as can be seen in FIGS. 7A to 7C, the introduction of the second module 2 into the first module 1 (arrow A) causes the associated elastically deformable arm 30 to deflect (FIG. 7B) and consequently lifts the protrusion 31 of this arm in order to disengage it from the path of rotation of the lever 6, thus releasing it to start its rotation stroke for controlling the driving means.

These means for locking with respect to rotation, in the case of the present embodiment, are associated with the driving means described in support of the first embodiment.

The latter are therefore not, in this case, used for abutting in order to block the coupling of the first and second modules, the means for locking the lever with respect to rotation guaranteeing the position thereof prior to the driving in translation of the second module.

On the other hand, they still advantageously carry out their function of driving by cam effect and reciprocal locking in the coupling end position.

More generally, it should also be noted that, in the two embodiments, the lever and the first and second modules (apart from electric contact elements) are moulded from plastics material.

Of course, the present invention is not limited to the embodiments described and illustrated, but covers any variant of execution.

In particular, the elastically deformable arm may be in the form of a double arm, the branches of which are connected to each other, and bear one a protrusion and the other a ramp.

These two elements may also be borne, for example, by a plate, connected to the arm. Furthermore, the elastically deformable arm may be connected to a lateral wall of the module instead of the upper wall.

An arrangement of these means for locking with respect to rotation at the lower wall of the module is also conceivable.

The invention claimed is:

1. A connector comprising:

a first module on which a lever is mounted so as to be able to rotate, and a second module, the first and second modules having complementary engagement profiles and receiving complementary contact elements, the lever and the second module comprising:

first complementary means for driving the second module in translation in a coupling direction of the first and second modules, under the action of the rotation of the lever, the first complementary means for driving are suitable for abutting to block the coupling of the first and second modules before the contact between the complementary contact elements is established upon the introduction of the second module into the first module as long as the lever does not occupy a rotation-stroke starting position for the purpose of the driving in translation;

second complementary means for reciprocal locking in a coupling end position, wherein the second complementary means for reciprocal locking comprise a tooth on the second module and at least one hump fixed with respect to rotation on the lever and configured for engaging with a sidewall of the tooth; and the lever comprising at least one arched prominence fixed with respect to rotation on the lever, the arched prominence being fully detached from the hump and having an abutment surface.

2. A connector according to claim 1, wherein the lever comprises, on an inner face of a manoeuvring arm turned towards the first module, a mounting protuberance engaged to rotate in an orifice of a lateral wall of the first module.

3. A connector according to claim 1, wherein said at least one arched prominence tapers towards one of its free ends, by means of which it is capable of engaging with a respective flank of a tooth of the second module in order to participate in the reciprocal locking of the first and second modules in the coupling end position.

4. A connector according to claim 1, wherein one of the first and second modules comprises at least one rail for guiding in translation in the coupling direction, and the other comprises at least one groove in which a guide rail is intended to slide.

5. A connector according to claim 1, further comprising a means for locking the lever with respect to rotation in its rotation-stroke starting position, which are suitable for being disengaged under the action of the introduction of the second module into the first module.

6. A connector according to claim 1, wherein the lever comprises, for the driving in translation of the second module, at least one structure forming a cam track suitable, upon the manoeuvring of the lever, for acting on a cam-follower member protruding from the second module.

7. A connector according to claim 6, wherein the at least one arched prominence forms internally a cam track for the respective cam-follower member and externally the abutment surface for this same cam-follower member upon the introduction of the second module into the first module as long as the lever does not occupy a rotation-stroke starting position.

8. A connector according to claim 7, wherein said at least one locking hump has, on one hand, a central part which is semicircular overall, the curved surface of which is turned towards the cam track, in order to form therewith a receiving channel for the respective cam-follower member, and, on the other hand, a nose and a locking head which is suitable for engaging with the flank of the complementary respective tooth provided on the second module, the nose and the head extending the central part so as to form between them an indentation capable of straddling this tooth upon the manoeuvring of the lever.

9. A connector according to claim 8, wherein the head of the hump is suitable for participating in the driving in translation of the second module upon the manoeuvring of the lever.

10. A connector according to claim 7, wherein the arched prominence protrudes from a protrusion which is overall in the shape of a disc which is coaxial to the axis of rotation of the lever, which disc itself protrudes from the mounting protuberance.

11. A connector according to claim 10, wherein the locking hump protrudes from the protrusion which is overall in the shape of a disc.

12. A connector according to claim 6, wherein the cam-follower member is a peg.

13. A connector according to claim 6, wherein the cam track has an open first end defined by the detachment between the arched protuberance and the hump and an open second end defined by the detachment between the arched protuberance and the hump.

14. A connector according to claim 13, wherein the cam follower is positioned outside the cam track and adjacent one of the open first end and the open second end when the lever is closed.

15. A connector comprising:

a first module on which a lever is mounted so as to be able to rotate, the first module comprising, for locking the lever with respect to rotation, at least one elastically deformable arm having a protrusion via which it is suitable for engaging with a complementary protrusion of the lever for blocking the latter with respect to rotation and a ramp which interferes with the path of an appendage for the deflection of the ramp and the releasing of the lever, and a second module, wherein the appendage is integral with the second module, and the first and second modules having complementary engagement profiles and receiving complementary contact elements, the lever and the second module comprising:

complementary means for driving the second module in translation in a coupling direction of the first and second modules, under the action of the rotation of the lever, the complementary means for driving the second module comprising means for locking the lever with respect to rotation in its rotation-stroke starting position, which means are suitable for being disengaged under the action of the introduction of the second module into the first module.

16. A connector according to claim 15, wherein the at least one elastically deformable arm extends parallel to the coupling direction of the first and second modules and is connected by a transverse tab to a wall of the first module.

17. A connector according to claim 15, wherein the elastically deformable arm bears the protrusion and the ramp at the free end which is at the opposite end from the one by which it is connected to the wall of the module.

18. A connector according to claim 15, wherein the protrusion and the ramp are arranged side by side.

19. A connector according to claim 15, wherein the protrusion and the ramp extend in the vicinity of the end of the first module which is at the opposite end from the one by which the second module is engaged in the first module.

20. A connector according to claim 15, wherein the lever comprises two lateral branches connected by a central branch, so as to form a double lever, arranged straddling the first module.

21. A connector according to claim 15, wherein the first module comprises an interfacial seal.

22. A connector according to claim 15, wherein the complementary contact elements are in the form of pins and female electrical contact members which are suitable for receiving these pins.

23. A connector according to claim 15, wherein the lever and each module are moulded from plastics material.

* * * * *